US011286936B2

(12) United States Patent
Kim et al.

(10) Patent No.: US 11,286,936 B2
(45) Date of Patent: Mar. 29, 2022

(54) SCROLL COMPRESSOR

(71) Applicant: Hanon Systems, Daejeon (KR)

(72) Inventors: Hong Min Kim, Daejeon (KR); Chi Myeong Moon, Daejeon (KR); Kweon Soo Lim, Daejeon (KR); Soo Cheol Jeong, Daejeon (KR)

(73) Assignee: Hanon Systems, Daejeon (KR)

( * ) Notice: Subject to any disclaimer, the term of this patent is extended or adjusted under 35 U.S.C. 154(b) by 179 days.

(21) Appl. No.: 16/736,398

(22) Filed: Jan. 7, 2020

(65) Prior Publication Data

US 2020/0232466 A1 Jul. 23, 2020

(30) Foreign Application Priority Data

Jan. 18, 2019 (KR) ..... 10-2019-0006828

(51) Int. Cl.

| | |
|---|---|
| ***F04C 28/24*** | (2006.01) |
| ***F04C 18/02*** | (2006.01) |
| ***F04C 29/02*** | (2006.01) |
| ***F04C 29/12*** | (2006.01) |

(52) U.S. Cl.

CPC ..... *F04C 28/24* (2013.01); *F04C 18/0215* (2013.01); *F04C 29/026* (2013.01); *F04C 29/126* (2013.01); *F04C 2210/206* (2013.01); *F04C 2270/215* (2013.01)

(58) Field of Classification Search

CPC .... F04C 28/24; F04C 18/0215; F04C 29/026; F04C 29/126

See application file for complete search history.

(56) References Cited

U.S. PATENT DOCUMENTS

| | | | | |
|---|---|---|---|---|
| 4,892,469 | A * | 1/1990 | McCullough | F04C 18/0215 418/151 |
| 10,527,041 | B2 * | 1/2020 | Moon | F04C 29/028 |
| 2013/0189143 | A1 * | 7/2013 | Yamashita | F04C 28/24 418/55.1 |
| 2015/0198159 | A1 * | 7/2015 | Yamashita | F04C 23/008 418/55.1 |

FOREIGN PATENT DOCUMENTS

KR 20160108037 A 9/2016

* cited by examiner

*Primary Examiner* — Deming Wan

(74) *Attorney, Agent, or Firm* — Norton Rose Fulbright US LLP; James R. Crawford

(57) ABSTRACT

The present disclosure relates to a scroll compressor, and it is possible to constitute a depressurized resistance value of a first orifice disposed on an oil recovery part to be lower than a depressurized resistance value of a second orifice, thereby maintaining/enhancing volume efficiency upon driving under a high pressure condition where a pressure of discharged refrigerant is high by increasing the back pressure of a back pressure chamber.

19 Claims, 6 Drawing Sheets

SCROLL COMPRESSOR

CROSS-REFERENCE(S) TO RELATED APPLICATIONS

This application claims priority to Korean Patent Application No. 10-2019-0006828, filed on Jan. 18, 2019, the disclosure of which is incorporated herein by reference in its entirety.

BACKGROUND OF THE DISCLOSURE

Field of the Disclosure

The present disclosure relates to a scroll compressor, and more particularly, to a scroll compressor, which may constitute a depressurized resistance value of a first orifice disposed on an oil recovery part to be lower than a depressurized resistance value of a second orifice, thereby maintaining/enhancing volume efficiency upon driving under a high pressure condition where a pressure of discharged refrigerant is high by increasing the back pressure of a back pressure chamber.

Description of the Related Art

In general, a vehicle is installed with an air conditioning (A/C) for the cooling and heating of the indoor. Such an air conditioning includes, as a configuration of a cooling system, a compressor for compressing a low temperature and low pressure gaseous refrigerant introduced from an evaporator into a high temperature and high pressure gaseous refrigerant to send it to a condenser.

The compressor includes a reciprocating type for compressing the refrigerant according to the reciprocating motion of a piston and a rotary type for performing the compression while performing the rotational motion. The reciprocating type includes a crank type for delivering to a plurality of pistons by using a crank, a swash plate type for delivering to a rotary shaft installed with a swash plate, and the like according to the delivery method of a drive source, and the rotary type includes a vane rotary type that uses a rotating rotary shaft and vane, and a scroll type that uses an orbiting scroll and a fixed scroll.

The scroll compressor is widely used for the refrigerant compression in the air conditioning, and the like because it has the advantage in that the suction, compression, and discharge strokes of the refrigerant may be smooth to obtain a stable torque while obtaining a relatively high compression ratio compared to other types of compressors.

The scroll compressor compresses the refrigerant through the interaction between the orbiting scroll and the fixed scroll. At this time, the orbiting scroll is connected to an eccentric bush disposed on the end portion of a drive shaft connected to a motor, and forms a compression region with the fixed scroll by a rotational force delivered by the eccentric bush according to the rotation of the drive shaft.

Such a scroll compressor may be implemented in a motor-driven type, and in this case, it may belong to the category of a motor-driven compressor.

The motor-driven compressor rotates an orbiting scroll by driving a motor, and the motor generates a rotational force by the electromagnetic interaction between a stator and a rotor, thereby rotating a drive shaft connected to the rotor.

FIG. 1 is a partial side cross-sectional diagram of an example of a conventional scroll compressor 1. Referring to FIG. 1, if refrigerant flows from a suction chamber (D) into a compression chamber (C), an eccentric bush 2*c* connected to a shaft 2*a* and a pin 2*b* disposed through a center head 8 rotates and therefore, an orbiting scroll 3*a* connected with the eccentric bush 2*c* also rotates. The refrigerant in the compression chamber (C) is compressed by the mutual compression operation between the orbiting scroll 3*a* and a fixed scroll 3*b* and flows into a discharge chamber 4 through a discharge hole 3*c*.

At this time, the refrigerant flowing into the discharge chamber 4 contains oil because it passes through the suction chamber (D) in which a motor (not illustrated) has been disposed. Therefore, an oil separator 5 for separating the oil is formed in the discharge chamber 4.

The refrigerant containing the oil flowing into the oil separator 5 flows into a through hole 3*d* formed in the fixed scroll 3*b*, and is depressurized through a first orifice 6*a* disposed on an oil recovery part 6, and a portion of the refrigerant flows into a back pressure chamber (B) through a back pressure chamber passage 7*a*.

Further, the other portion of the refrigerant is depressurized through a second orifice 6*b*, and flows back into the suction chamber (D) in which a motor (not illustrated) has been disposed through a suction chamber passage 7*b*.

Usually, conventionally, the refrigerant depressurized degrees of the first and second orifices 6*a*, 6*b* have been equally configured.

Meanwhile, upon driving under a high pressure condition where the pressure of discharged refrigerant is high, the orbiting scroll 3*a* is pushed toward the center head 8, which is the rear surface thereof, by the internal pressure of the compression chamber (C), and in this case, there is a problem in that the internal leak or the like occurs, thereby deteriorating volume efficiency. In order to solve this problem, the refrigerant having a sufficient back pressure should flow into the back pressure chamber (B).

RELATED ART DOCUMENT

Patent Document (Patent Document 1) Korean Patent Laid-Open Publication No. 10-2016-0108037

SUMMARY OF THE DISCLOSURE

The present disclosure is intended to solve the above problem as described above, and an object of the present disclosure is to a scroll compressor, which may constitute a depressurized resistance value of a first orifice disposed on an oil recovery part to be lower than a depressurized resistance value of a second orifice, thereby maintaining/enhancing volume efficiency upon driving under a high pressure condition where a pressure of discharged refrigerant is high by increasing the back pressure of a back pressure chamber.

The present disclosure for achieving the object relates to a scroll compressor, and includes a casing; a drive part disposed in a drive part accommodation space formed inside the casing and for rotating a drive shaft; a center head in which the drive shaft passes through and is disposed and connected to the casing; an orbiting scroll connected to the drive shaft; a fixed scroll fixed to the inside of the casing, and forming a compression chamber for compressing refrigerant in interlock with the orbiting scroll; a discharge chamber formed on one side portion of the casing and through which the refrigerant is discharged; a back pressure chamber formed between the center head and the orbiting scroll; an oil recovery part for connecting an oil separator of the discharge chamber with a branch point branched to a back pressure chamber passage and a suction chamber passage formed in the center head, and for depressurizing the refrigerant and recovering oil; a first depressurized member disposed on a first oil recovery passage formed between the oil separator of the discharge chamber and the branch point in the oil recovery part, and for depressurizing the refrigerant; and a second depressurized member disposed on a second oil recovery passage formed between the branch point and the suction chamber passage in the oil recovery part, and for depressurizing the refrigerant, and a depressurized resistance value of the first depressurized member may be configured to be smaller than a depressurized resistance value of the second depressurized member.

Further, in an embodiment of the present disclosure, the first depressurized member may include a first orifice, a first spiral part wound a plurality of times may be formed on the outer circumferential surface of the first orifice, the second depressurized member may include a second orifice, and a second spiral part wound a plurality of times may be formed on the outer circumferential surface of the second orifice, and a passage spacing (S1) formed by the first spiral part may be configured to be greater than a passage spacing (S2) formed by the second spiral part.

Further, in an embodiment of the present disclosure, the first depressurized member may include a first orifice, a first spiral part wound a plurality of times may be formed on the outer circumferential surface of the first orifice, the second depressurized member may include a second orifice, and a second spiral part wound a plurality of times may be formed on the outer circumferential surface of the second orifice, and a length (L1) of the first orifice may be configured to be shorter than a length (L2) of the second orifice.

Further, in an embodiment of the present disclosure, the first depressurized member may include a depressurized check valve, the second depressurized member may include a second orifice, a second spiral part wound a plurality of times may be formed on the outer circumferential surface of the second orifice, and a depressurized resistance value of the depressurized check valve may be configured to be smaller than a depressurized resistance value of the second orifice.

Further, in an embodiment of the present disclosure, the first depressurized member may include a depressurized check valve connected with the oil separator of the discharge chamber; and a first orifice disposed between the depressurized check valve and the branch point, and having a first spiral part wound a plurality of times formed on the outer circumferential surface thereof, and the second depressurized member may include a second orifice having a second spiral part wound a plurality of times formed on the outer circumferential surface thereof, and a total depressurized resistance value formed by the depressurized check valve and the first orifice may be configured to be smaller than a depressurized resistance value of the second orifice.

Further, in an embodiment of the present disclosure, the passage spacing (S1) formed by the first spiral part may be configured to be greater than the passage spacing (S2) formed by the second spiral part.

Further, in an embodiment of the present disclosure, the length (L1) of the first orifice may be configured to be shorter than the length (L2) of the second orifice.

Further, in an embodiment of the present disclosure, the first depressurized member may include a first orifice, a first spiral part wound a plurality of times may be formed on the outer circumferential surface of the first orifice, the second depressurized member may include a second orifice, and a second spiral part wound a plurality of times may be formed on the outer circumferential surface of the second orifice, and at least a portion of the inner surface of the first oil recovery passage may be formed with an inner diameter expansion part having a greater spacing with the first orifice.

Further, in an embodiment of the present disclosure, the inner diameter expansion part may be formed at the side adjacent to the branch point on the first oil recovery passage.

Further, in an embodiment of the present disclosure, an inner diameter (Db) of the inner diameter expansion part may be configured to be greater than an inner diameter (Da) of the first oil recovery passage, and the refrigerant flowing through the first spiral part of the first orifice on the inner diameter expansion part may be configured to be relatively less depressurized or not to be depressurized.

Further, in an embodiment of the present disclosure, a placement length (Lc) of the inner diameter expansion part may be configured to be adjusted from a length (L1) of the first oil recovery passage to adjust a depressurized range of the refrigerant flowing through the first spiral part of the first orifice.

Further, in an embodiment of the present disclosure, an outer diameter of the first orifice including the first spiral part may be configured to be equal to or great than an inner diameter (Da) of the first oil recovery passage so that the first orifice is press-fitted into and position-fixed to the first oil recovery passage, and an outer diameter of the second orifice including the second spiral part may be configured to be equal to or great than an inner diameter (Da) of the second oil recovery passage so that the second orifice is press-fitted into and position-fixed to the second oil recovery passage.

Further, in an embodiment of the present disclosure, a passage spacing (S1) formed by the first spiral part may be configured to be greater than a passage spacing (S2) formed by the second spiral part.

Further, in an embodiment of the present disclosure, the first oil recovery passage may be formed through a wall portion of the fixed scroll, and a sealing member may be disposed between the first depressurized member and the second depressurized member.

Further, in an embodiment of the present disclosure, the first depressurized member may be inserted from the oil separator toward the branch point on the first oil recovery passage, the second depressurized member may be inserted from the branch point toward the suction chamber on the second oil recovery passage, and oil may pass through the first and second depressurized members in the oil separator and may be configured to be recovered toward the suction chamber.

According to the present disclosure, it is possible to constitute the depressurized resistance value of the first orifice disposed on the oil recovery part to be lower than the depressurized resistance value of the second orifice, thereby maintaining/enhancing the volume efficiency upon driving under a high pressure condition where the pressure of discharged refrigerant is high by increasing the back pressure of the back pressure chamber.

DESCRIPTION OF SPECIFIC EMBODIMENTS

Hereinafter, preferred embodiments of a scroll compressor according to the present disclosure will be described in detail with reference to the accompanying drawings.

First, a structure of a motor-driven compressor or a scroll compressor to which the present disclosure is applied will be described with reference to FIG. 2.

Figure 1:
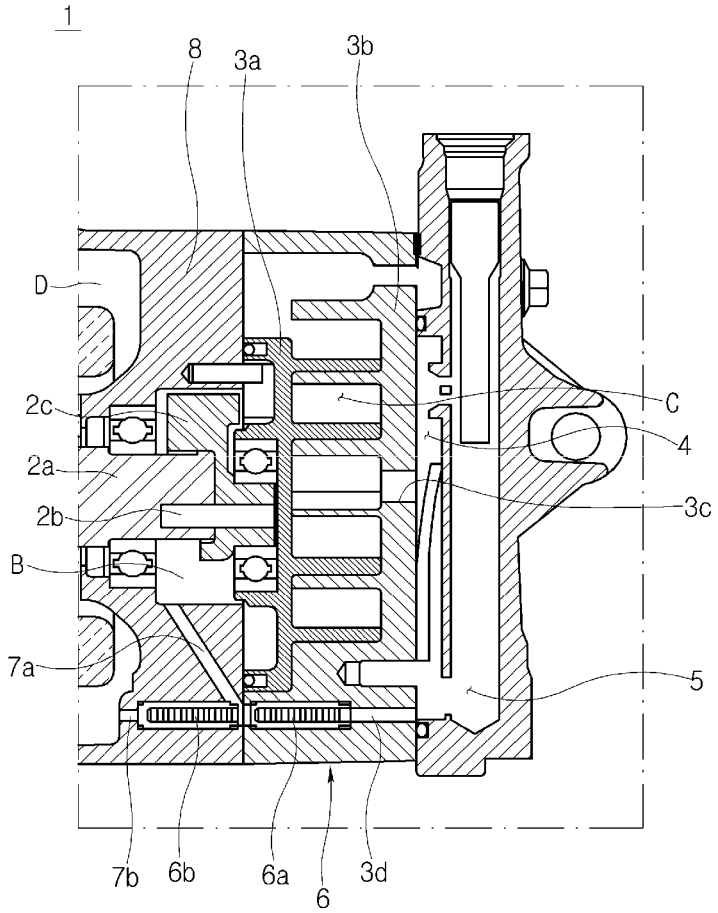
FIG. 1 is a partial side cross-sectional diagram illustrating a structure of an oil recovery part of a conventional scroll compressor.
Figure 2:
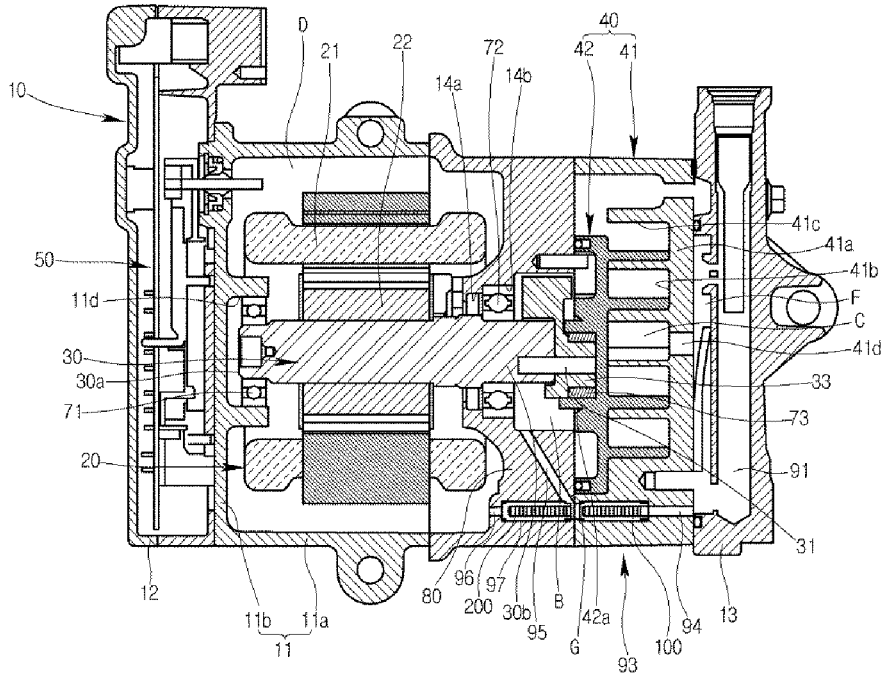
FIG. 2 is a diagram illustrating a general structure of a scroll compressor.

Referring to FIG. 2, the motor-driven compressor or the scroll compressor to which the present disclosure is applied may include a casing 10, a drive part 20 for generating a driving force inside the casing 10, a drive shaft 30 rotated by the drive part 20, and a compression mechanism 40 driven by the drive shaft 30 to compress refrigerant.

The casing 10 may include a first housing 11 for accommodating the drive part 20, a second housing 12 for accommodating an inverter 50 for controlling the drive part 20, and a third housing 13 for accommodating the compression mechanism 40.

The first housing 11 may include an annular wall 11*a*, a first partition 11*b* for covering one end portion of the annular wall 11*a*, and a center head 80 for covering the other end portion of the annular wall 11*a*, and the annular wall 11*a*, the first partition 11*b*, and the center head 80 may form a drive part accommodation space in which the drive part 20 is accommodated.

The second housing 12 may be coupled to the first partition 11*b* side to form an inverter accommodation space in which the inverter 50 is accommodated.

The third housing 13 may be coupled to the center head 80 side to form a compression space in which the compression mechanism 40 is accommodated.

Here, the center head 80 partitions the drive part accommodation space and the compression space, and serves as a main frame for supporting the compression mechanism 40, and a bearing hole 14*a* through which the drive shaft 30 for interlocking the drive part 20 with the compression mechanism 40 passes may be formed at the center side of the center head 80.

Meanwhile, the fixed scroll 41 of the compression mechanism 40 may be fastened to the center head 80, and the third housing 13 may be fastened to the fixed scroll 41. However, it is not limited thereto, and the third housing 13 may accommodate the compression mechanism 40 and may also be fastened to the center head 80.

The drive part 20 may include a stator 21 fixed to the first housing 11 and a rotor 22 rotated by the interaction with the stator 21 inside the stator 21.

The drive shaft 30 may pass through the center portion of the rotor 22, one end portion of the drive shaft 30 may be protruded to the first partition 11*b* side with respect to the rotor 22, and the other end portion of the drive shaft 30 may be protruded to the center head 80 side with respect to the rotor 22.

One end portion 30*a* of the drive shaft 30 may be rotatably supported by a first bearing 71 provided at the center side of the first partition 11*b*.

Here, a first support groove 11*d* into which the first bearing 71 and the one end portion of the drive shaft 30 are inserted may be formed at the center side of the first partition 11*b*, and the first bearing 71 may be interposed between the first support groove 11*d* and the one end portion of the drive shaft 30.

The other end portion 30*b* of the drive shaft 30 may be connected to the compression mechanism 40 through the bearing hole 14*a* of the center head 80.

Further, the other end portion 30*b* of the drive shaft 30 is connected to the eccentric bush 33 by a connecting pin 31. The eccentric bush 33 may be rotatably supported by a third bearing 73 provided in the compression mechanism 40. Further, the rotational force is delivered to an orbiting scroll 42 in connection with the third bearing 73.

Here, a second support groove 14*b* in which the second bearing 72 is disposed may be formed in the bearing hole 14*a* of the center head 80, and the second bearing 72 may be interposed between the second support groove 14*b* and the drive shaft 30.

Further, a boss part 42*a* into which the third bearing 73 and the eccentric bush 33 are inserted may be formed in the orbiting scroll 42 of the compression mechanism 40, and the third bearing 73 may be interposed between the boss part 42*a* and the eccentric bush 33.

The compression mechanism 40 may include the fixed scroll 41 disposed at the opposite side of the drive part 20 with respect to the center head 80 and the orbiting scroll 42 engaged to the fixed scroll 41 to form a compression chamber (C) and pivoted by the drive shaft 30.

The fixed scroll 41 may include a disc-shaped fixed head plate part 41*a* and a fixed lap 41*c* protruded from a compression surface 41*b* of the fixed head plate part 41*a* to be engaged to the orbiting scroll 42.

The center side of the fixed head plate part 41*a* may be formed with a discharge port 41*d* for discharging the refrigerant compressed in the compression chamber through the fixed head plate part 41*a*. Here, the discharge port 41*d* may be communicated with a discharge space formed between the fixed scroll 41 and the third housing 13.

The scroll compressor according to this configuration may allow the drive shaft 30 to deliver a rotational force to the orbiting scroll 42 while rotating together with the rotor 22 if power is applied to the drive part 20. Then, the orbiting scroll 42 may be pivoted by the drive shaft 30, such that the compression chamber (C) may be continuously moved toward the center side, thereby reducing the volume. Then, the refrigerant may flow into the drive part accommodation space through a refrigerant inlet (not illustrated) formed on the annular wall 11*a* of the first housing 11. Then, the refrigerant in the drive part accommodation space may be sucked into the compression chamber through a refrigerant pass-through hole (not illustrated) formed in the center head 80 of the first housing 11. Then, the refrigerant sucked into the compression chamber (C) may be compressed while being moved to the center side along the movement path of the compression chamber (C) to be discharged to the discharge space through the discharge port 41*d*. The refrigerant discharged into the discharge space repeats a series of processes that are discharged to the outside of the scroll compressor through a refrigerant discharge port formed in the third housing 13.

In this process, the drive shaft 30 may be rotatably supported by the first bearing 71 and the second bearing 72, the orbiting scroll 42 may be supported rotatably with respect to the drive shaft 30 by the third bearing 73, and the third bearing 73 may be formed of the bearing 73 different from the first bearing 71 and the second bearing 72 in order to reduce the weight and size of an assembly of the third bearing 73 and the orbiting scroll 42 (hereinafter, an orbiting moving body).

Specifically, the first bearing 71 and the second bearing 72 fixed to the casing 10 may be formed of a ball bearing, respectively, to minimize friction loss.

On the other hand, the third bearing 73, which is proportional to the weight and size of the orbiting moving body as it is pivoted together with the orbiting scroll 42, may be formed of a needle roller bearing or a slide bush bearing that has a smaller weight and size and a lower cost than the ball bearing. Further, the third bearing 73 may be press-fitted and fastened to the boss part 42*a* by a predetermined press-fitting force.

Hereinafter, a structure of an oil recovery part that is the main feature of the present disclosure will be described.

FIGS. 3 to 8 illustrate various embodiments of structures of first and second depressurized members 100, 200 of the scroll compressor according to the present disclosure.

First, the scroll compressor according to the present disclosure may be configured to include the casing 10, the drive part 20, the center head 80, the orbiting scroll 42, the fixed scroll 41, a discharge chamber (F), the back pressure chamber (B), an oil recovery part 93, the first depressurized member 100, and the second depressurized member 200.

As described above, the drive part 20 is disposed in the drive part 20 accommodation space formed inside the casing 10 and is provided to rotate the drive shaft 30. The center head 80 may have the drive shaft 30 passing through and disposed and may be formed integrally with the casing 10 or may be bolt-fastened and connected to the casing 10.

The orbiting scroll 42 may be connected to the drive shaft 30 to be rotated, the fixed scroll 41 may be fixed to the inside of the casing 10, and may form the compression chamber (C) for compressing the refrigerant by the interaction with the orbiting scroll 42.

The discharge chamber (F) may be a discharge space formed in the third housing 13 corresponding to one side portion of the casing 10 and through which refrigerant is discharged at the discharge port 41*d*. The internal lower side of the discharge chamber (F) may be formed with an oil separator 91 for separating oil from the refrigerant.

The back pressure chamber (B) may be a back pressure space formed between the center head 80 and the orbiting scroll 42.

Here, the oil recovery part 93 may connect the oil separator 91 of the discharge chamber (F) with a branch point (G) branched to a back pressure chamber passage 95 and a suction chamber passage 96 formed in the center head 80, and may be provided to depressurize the refrigerant and recover the oil.

Next, the first depressurized member 100 may be disposed on the first oil recovery passage 94 formed between the oil separator 91 of the discharge chamber (F) and the branch point (G) in the oil recovery part 93, and may be provided to depressurize the refrigerant.

The first depressurized member 100 may be inserted from the oil separator 91 toward the branch point (G) on the first oil recovery passage 94 to be press-fitted and fixed thereto.

In an embodiment of the present disclosure, the first oil recovery passage 94 may be formed through the wall portion of the fixed scroll 41. The wall portion of the fixed scroll 41 may be the outermost boundary wall in the fixed scroll 41.

Further, the second depressurized member 200 may be disposed on the second oil recovery passage 97 formed between the branch point (G) and the suction chamber passage 96 in the oil recovery part 93, and may be provided to depressurize the refrigerant.

The second depressurized member 200 may be inserted from the branch point (G) toward the suction chamber (B) on the second oil recovery passage 97 to be press-fitted and fixed thereto.

In an embodiment of the present disclosure, although not illustrated in the drawings, a sealing member (not illustrated) may be disposed between the first depressurized member 100 and the second depressurized member 200.

Basically, there is a sealing treatment between the fixed scroll 41 and the center head 80 to prevent the leakage of the refrigerant, and here, since the first oil recovery passage 94 is formed on the wall portion of the fixed scroll 41, and the second oil recovery passage 97 is formed on the center head 80, measures are required for the sealing for preventing the leakage of the refrigerant between the first and second oil recovery passages 94, 97 forming a hole contacting each other. Therefore, the sealing member (not illustrated) may be disposed between the first and second depressurized members 100, 200 disposed in the first and second oil recovery passages 94, 97, respectively. Additionally, the sealing member (not illustrated) may perform a function of supporting the first depressurized member 100 not to be displaced from the inside of the first oil recovery passage 94 by the hydraulic pressure of the refrigerant discharged at a high pressure into the discharge chamber.

In an embodiment of the present disclosure, the oil may be recovered toward the suction chamber (D) through the first and second depressurized members 100, 200 in the oil separator 91.

In the present disclosure, a depressurized resistance value (Ra) of the first depressurized member 100 may be formed smaller than a depressurized resistance value (Rb) of the second depressurized member 200.

Here, if the pressure for each part of the scroll compressor is defined as a pressure (Pd) of the discharge chamber (F), a pressure (Pc) of the back pressure chamber (B), and a pressure (Ps) of the suction chamber (D), the magnitude order of the pressure value at each part is determined as the pressure (Pd) of the discharge chamber (F)>the pressure (Pc) of the back pressure chamber (B)>the pressure (Ps) of the suction chamber (D).

This is aligned in the above-described pressure magnitude order because the refrigerant flowing into the first oil recovery passage 94 from the discharge chamber (F) is primarily depressurized in the first depressurized member 100 and then flows into the branch point (G), and at this time, the refrigerant flows directly into the back pressure chamber (B), and the refrigerant is secondarily depressurized in the second depressurized member 200 disposed on the second oil recovery passage 97 and then flows into the suction chamber (D).

The present disclosure adjusts the depressurized degree for the refrigerant flowing from the discharge chamber (F) to the back pressure chamber (B) in order to solve a problem of reducing the volume efficiency caused by not properly pushing the orbiting scroll 42 toward the fixed scroll 41 due to a weak back pressure of the back pressure chamber (B) upon driving the scroll compressor under a high pressure condition that has been the conventional problem.

Figure 3:
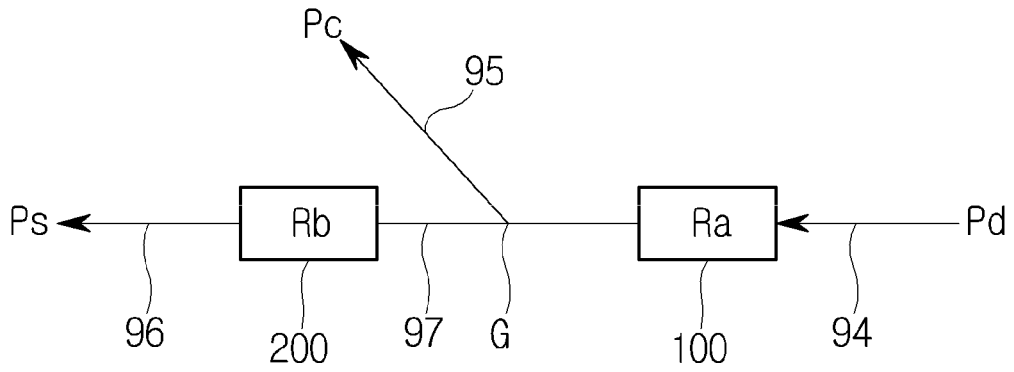
FIG. 3 is a diagram illustrating the relative depressurized concept in structures of first and second depressurized members in the present disclosure.

FIG. 3 is a diagram illustrating the relative depressurized concept in the structures of the first and second depressurized members 100, 200 in the present disclosure.

Referring to FIG. 3, magnitudes are firstly determined in the order of the pressure (Pd) of the discharge chamber (F)>the pressure (Pc) of the back pressure chamber (B)>the pressure (Ps) of the suction chamber (D).

Here, the depressurized resistance value (Ra) of the first depressurized member 100 and the depressurized resistance value (Rb) of the second depressurized member 200 may be designated. The term depressurized resistance value may be defined as a processed value at which the first and second depressurized members 100, 200 reduce the pressure.

That is, the meaning that the depressurized resistance value is great means that the depressurized degree is great, and also means as having been processed to occur great depressurized. On the contrary, the meaning that the depressurized resistance value is small means that the depressurized degree is small, and also means as having been processed to occur small depressurized.

The present disclosure is configured so that the depressurized resistance value (Ra) of the first depressurized member 100 is smaller than the depressurized resistance value (Rb) of the second depressurized member 200. That is, when the refrigerant passes through the first depressurized member 100 is depressurized relatively smaller than when passing through the second depressurized member 200.

Therefore, the pressure (Pc) of the back pressure chamber (B) is higher than the conventional pressure value, which may increase the back pressure, thereby pushing the orbiting scroll 42 toward the fixed scroll 41 more strongly upon driving under a high pressure condition.

Figure 4:
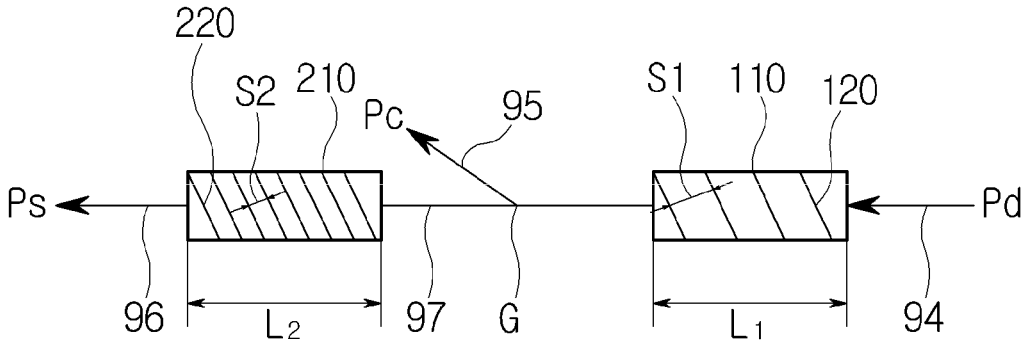
FIG. 4 is a diagram illustrating a first embodiment of the first and second depressurized members for the relative depressurized concept illustrated in FIG. 3.

Next, FIG. 4 illustrates a first embodiment in which the first and second depressurized members 100, 200 for the relative depressurized concept illustrated in FIG. 3 are specifically implemented.

Referring to FIG. 4, in the first embodiment of the first and second depressurized members 100, 200, the first depressurized member 100 includes a first orifice 110, and a first spiral part 120 wound a plurality of times through which the refrigerant passes may be formed on the outer circumferential surface of the first orifice 110.

Further, the second depressurized member 200 may include a second orifice 210, and a second spiral part 220 wound a plurality of times through which the refrigerant passes may be formed on the outer circumferential surface of the second orifice 210.

In the first embodiment of the first and second depressurized members 100, 200, a length (L1) of the first orifice 110 and a length (L2) of the second orifice 210 are the same, and a passage spacing (S1) formed by the first spiral part 120 may be configured to be greater than a passage spacing (S2) formed by the second spiral part 220.

Specifically, under a condition that the lengths (L1, L2) of the first and second orifices 110, 210 are the same, the number of spirals of the first spiral part 120 processed on the outer circumferential surface of the first orifice 110 is smaller than the number of spirals of the second spiral part 220 processed on the outer circumferential surface of the second orifice 210. Therefore, the passage spacing (S1) formed by the first spiral part 120 is configured to be greater than the passage spacing (S2) formed by the second spiral part 220.

That is, since the refrigerant passes through the passage wound relatively a small number of times with a wide spacing in the first depressurized member 100, the depressurized degree occurs low compared to the refrigerant the second depressurized member 200 passing through the passage wound more times with a narrower spacing than the first depressurized member 100. This means that the depressurized resistance value (Ra) of the first depressurized member 100 is smaller than the depressurized resistance value (Rb) of the second depressurized member 200.

The first embodiment of the present disclosure is configured so that the depressurized resistance value (Ra) of the first depressurized member 100 is smaller than the depressurized resistance value (Rb) of the second depressurized member 200 by the above-described structure. That is, when the refrigerant passes through the first depressurized member 100 is depressurized relatively smaller than when passing through the second depressurized member 200.

Therefore, the pressure (Pc) of the back pressure chamber (B) is higher than the conventional pressure value, which may increase the back pressure, thereby pushing the orbiting scroll 42 toward the fixed scroll 41 more strongly upon driving under a high pressure condition.

Figure 5:
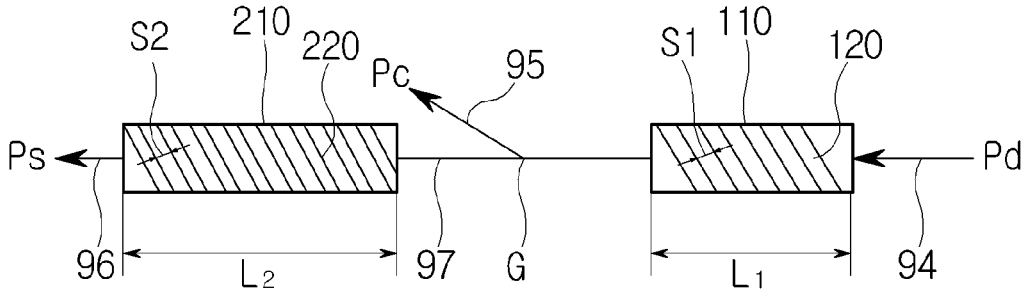
FIG. 5 is a diagram illustrating a second embodiment of the first and second depressurized members for the relative depressurized concept illustrated in FIG. 3.

Next, FIG. 5 illustrates a second embodiment in which the first and second depressurized members 100, 200 for the relative depressurized concept illustrated in FIG. 3 are specifically implemented.

Referring to FIG. 5, the first depressurized member 100 includes the first orifice 110, and the first spiral part 120 wound a plurality of times through which refrigerant passes through may be formed on the outer circumferential surface of the first orifice 110.

The second depressurized member 200 may include the second orifice 210, and the second spiral part 220 wound a plurality of times through which refrigerant passes through may be formed on the outer circumferential surface of the second orifice 210.

The second embodiment of the first and second depressurized members 100, 200 may be configured so that the length (L1) of the first orifice 110 is shorter than the length (L2) of the second orifice 210, and may be configured so that the passage spacing (S1) formed by the first spiral part 120 and the passage spacing (S2) formed by the second spiral part 220 are the same.

Specifically, since it is configured so that the passage spacings (S1, S2) formed by the first and second spiral parts 120, 220 are the same, and the length (L1) of the first orifice 110 is shorter than the length (L2) of the second orifice 210, the number of spirals of the first spiral part 120 processed on the outer circumferential surface of the first orifice 110 is smaller than the number of spirals of the second spiral part 220 processed on the outer circumferential surface of the second orifice 210.

Since the refrigerant passes through the passage wound relatively a small number of times in the first depressurized member 100, the depressurized degree occurs low compared to the refrigerant in the second depressurized member 200 passing through the passage wound relatively more times than the first depressurized member 100. This means that the depressurized resistance value (Ra) of the first depressurized member 100 is smaller than the depressurized resistance value (Rb) of the second depressurized member 200.

The second embodiment of the present disclosure is configured so that the depressurized resistance value (Ra) of the first depressurized member 100 is smaller than the depressurized resistance value (Rb) of the second depressurized member 200 by the above-described structure. That is, when the refrigerant passes through the first depressurized member 100 is depressurized relatively smaller than when passing through the second depressurized member 200.

Therefore, the pressure (Pc) of the back pressure chamber (B) is higher than the conventional pressure value, which may increase the back pressure, thereby pushing the orbiting scroll 42 toward the fixed scroll 41 more strongly upon driving under a high pressure condition.

Figure 6:
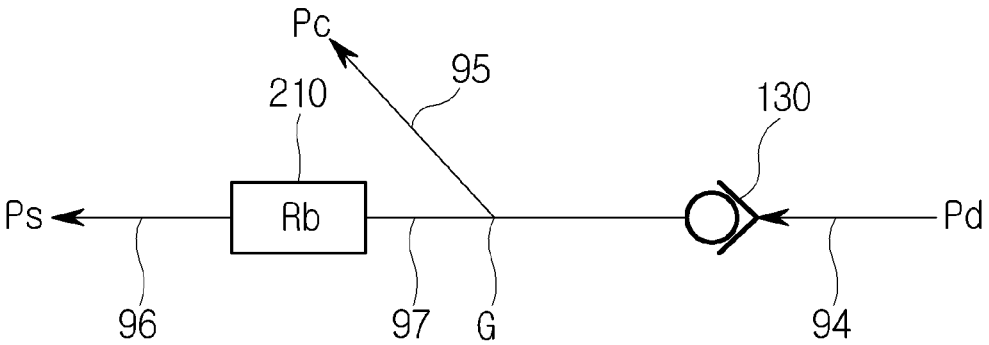
FIG. 6 is a diagram illustrating a third embodiment of the first and second depressurized members for the relative depressurized concept illustrated in FIG. 3.

Next, FIG. 6 illustrates a third embodiment in which the first and second depressurized members 100, 200 for the relative depressurized concept illustrated in FIG. 3 are specifically implemented.

Referring to FIG. 6, the first depressurized member 100 includes a depressurized check valve 130, the second depressurized member 200 includes the second orifice 210, and the second spiral part 220 wound a plurality of times through which the refrigerant passes is formed on the outer circumferential surface of the second orifice 210; and the depressurized resistance value of the depressurized check valve 130 may be configured to be smaller than the depressurized resistance value of the second orifice 210.

Specifically, the valve opening and closing pressure of the depressurized check valve 130 is set to be relatively lower than the depressurized resistance value (Rb) of the second orifice 210. Here, the valve opening and closing pressure of the depressurized check valve 130 becomes the depressurized resistance value (Ra).

Therefore, when the valve opening and closing pressure of the depressurized check valve 130 is set to a difference between the pressure (Pc) of the discharge chamber (F) and the pressure (Pc) of the back pressure chamber (B), and the depressurized resistance value (Rb) of the second orifice 210 is set to a difference between the pressure (Pc) of the back pressure chamber (B) and the pressure (Ps) of the suction chamber (D), the valve opening and closing pressure of the depressurized check valve 130 is adjusted, and the number of wound passages and the passage spacing (S2) of the second spiral part 220 are adjusted to become Rb>Ra.

The third embodiment of the present disclosure is configured so that the depressurized resistance value (Ra) of the first depressurized member 100 is smaller than the depressurized resistance value (Rb) of the second depressurized member 200 by the above-described structure. That is, when the refrigerant passes through the first depressurized member 100 is depressurized relatively smaller than when passing through the second depressurized member 200.

Therefore, the pressure (Pc) of the back pressure chamber (B) is higher than the conventional pressure value, which may increase the back pressure, thereby pushing the orbiting scroll 42 toward the fixed scroll 41 more strongly upon driving under a high pressure condition.

Figure 7:
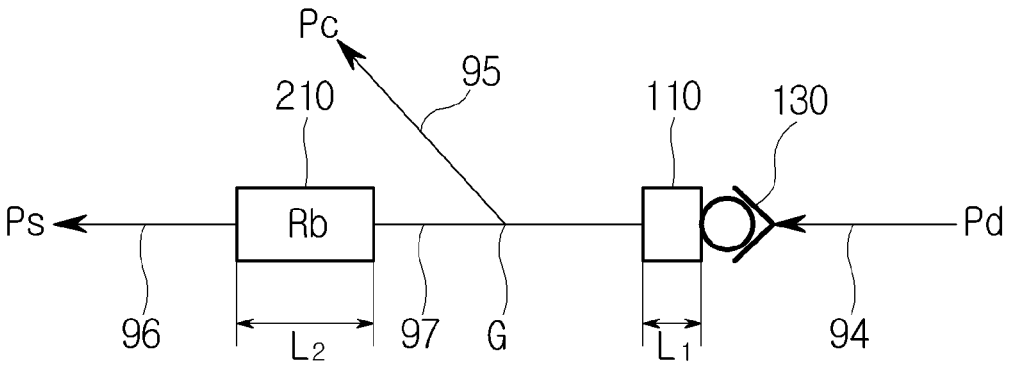
FIG. 7 is a diagram illustrating a fourth embodiment of the first and second depressurized members for the relative depressurized concept illustrated in FIG. 3.

Next, FIG. 7 illustrates a fourth embodiment in which the first and second depressurized members 100, 200 for the relative depressurized concept illustrated in FIG. 3 are specifically implemented.

Referring to FIG. 7, the first depressurized member 100 may include the depressurized check valve 130 connected with the oil separator 91 of the discharge chamber (F) and the first orifice 110 disposed between the depressurized check valve 130 and the branch point (G), and having the first spiral part 120 (see FIGS. 4 and 5) wound a plurality of times formed on the outer circumferential surface thereof.

Further, the second depressurized member 200 may include the second orifice 210 having the second spiral part 220 (see FIGS. 4 and 5) wound a plurality of times formed on the outer circumferential surface thereof.

Here, the total depressurized resistance value (Ra) formed by the depressurized check valve 130 and the first orifice 110 may be configured to be smaller than the depressurized resistance value (Rb) of the second orifice 210.

Specifically, the valve opening and closing pressure of the depressurized check valve 130 is set to be relatively lower than the depressurized resistance value (Rb) of the second orifice 210.

Therefore, when the valve opening and closing pressure value of the depressurized check valve 130, and the depressurized value by the number of wound passage times and the passage spacing (S1) formed by the first spiral part 120 are set to a difference between the pressure (Pc) of the discharge chamber (F) and the pressure (Pc) of the back pressure chamber (B), and the depressurized resistance value (Rb) for the number of wound passages and the passage spacing (S2) formed by the second spiral part 220 of the second orifice 210 is set to a difference between the pressure (Pc) of the back pressure chamber (B) and the pressure (Ps) of the suction chamber (D), the valve opening and closing pressure of the depressurized check valve 130 and the number of wound passage and the passage spacing (S1) of the first spiral part 120 are adjusted, and the number of wound passages and the passage spacing (S2) of the second spiral part 220 are adjusted to become Rb>Ra.

At this time, if the lengths (L1, L2) of the first and second orifices 110, 210 are configured to be the same as in the first embodiment (see FIG. 4), the passage spacing (S1) formed by the first spiral part 120 may be configured to be greater than the passage spacing (S2) formed by the second spiral part 220 in order to provide a difference in the depressurized resistance value. Since the detailed description is the same as in the above-described first embodiment, it will be omitted.

Alternatively, as in the second embodiment (see FIG. 5), the passage spacing (S1) formed by the first spiral part 120 and the passage spacing (S2) formed by the second spiral part 220 are configured to be the same, and the length (L1) of the first orifice 110 may be formed shorter than the length (L2) of the second orifice 210 in order to provide a difference in the depressurized resistance value. Since the detailed description is the same as in the above-described second embodiment, it will be omitted.

The fourth embodiment of the present disclosure is configured so that the depressurized resistance value (Ra) of the first depressurized member 100 is smaller than the depressurized resistance value (Rb) of the second depressurized member 200 by the above-described structure. That is, when the refrigerant passes through the first depressurized member 100 is depressurized relatively smaller than when passing through the second depressurized member 200.

Therefore, the pressure (Pc) of the back pressure chamber (B) is higher than the conventional pressure value, which may increase the back pressure, thereby pushing the orbiting scroll 42 toward the fixed scroll 41 more strongly upon driving under a high pressure condition.

Figure 8A:
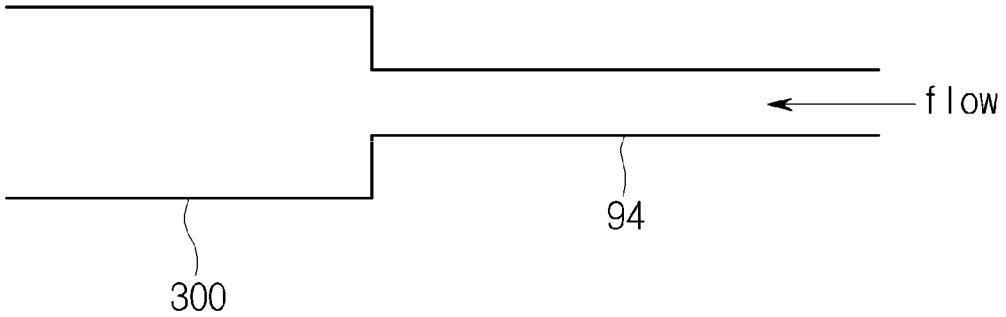
FIG. 8A is a diagram illustrating a fifth embodiment of the first and second depressurized members for the relative depressurized concept illustrated in FIG. 3.
Figure 8B:
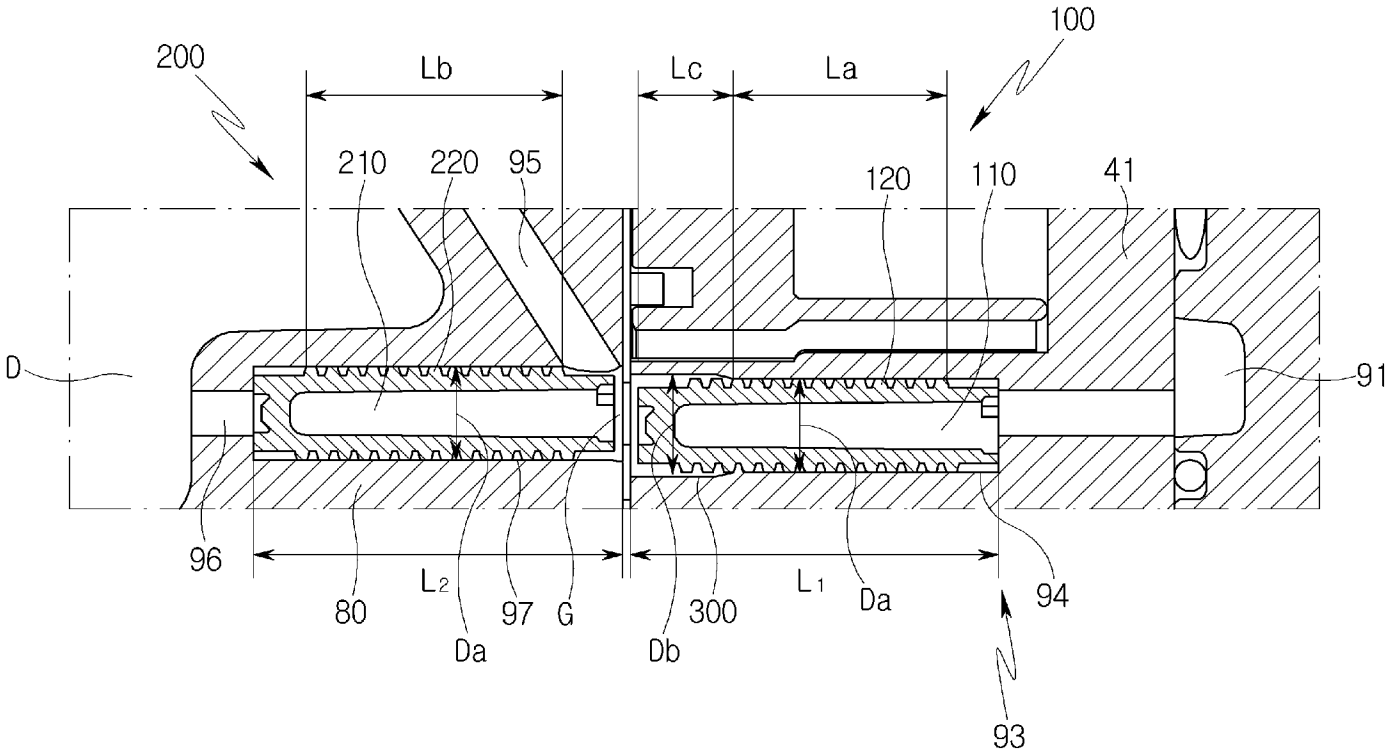
FIG. 8B is a diagram illustrating a placement structure on the scroll compressor of the first and second depressurized members illustrated in FIG. 8A.

Next, FIGS. 8A and 8B illustrate a fifth embodiment in which the first and second depressurized members 100, 200 for the relative depressurized concept illustrated in FIG. 3 are specifically implemented.

Referring to FIGS. 2, 8A, and 8B, the first depressurized member 100 includes the first orifice 110, and the first spiral part 120 wound a plurality of times through which refrigerant passes through may be formed on the outer circumferential surface of the first orifice 110.

Further, the second depressurized member 200 may include the second orifice 210, and the second spiral part 220 wound a plurality of times through which refrigerant passes may be formed on the outer circumferential surface of the second orifice 210.

Here, the outer diameter of the first orifice 110 including the first spiral part 120 may be formed to be equal to or greater than the inner diameter (Da) of the first oil recovery passage 94 so that the first orifice 110 is press-fitted into and position-fixed to the first oil recovery passage 94. Further, the outer diameter of the second orifice 210 including the second spiral part 220 may be formed to be equal to or greater than the inner diameter (Da) of the second oil recovery passage 97 so that the second orifice 210 is press-fitted into and position-fixed to the second oil recovery passage 97. As the first and second orifices 110, 210 are press-fitted into the first and second oil recovery passages 94, 97, the positions of the first and second orifices 110, 210 are prevented from being changed by a hydraulic pressure of the passing refrigerant.

Here, at least a portion of the inner surface of the first oil recovery passage 94 may be formed with an inner diameter expansion part 300 having a greater spacing with the first orifice 110. In an embodiment of the present disclosure, the inner diameter expansion part 300 may be formed at the side adjacent to the branch point (G) on the first oil recovery passage 94. It is natural that it may also be formed in the other portion on the first oil recovery passage 94.

The refrigerant passing between the outer circumferential surface of the first orifice 110 and the inner circumferential surface of the first oil recovery passage 94 passes through the spacing between the outer circumferential surface of the first orifice 110 and the inner circumferential surface of the first oil recovery passage 94 or the inner diameter (Da) when passing through the other portion on the first oil recovery passage 94 except for the inner diameter expansion part 300. Further, the refrigerant passes through the spacing between the outer circumferential surface of the first orifice 110 and the inner circumferential surface of the first oil recovery passage 94 or the inner diameter (Db) when passing through the inner diameter expansion part 300.

At this time, since the spacing (Db) is increased in the passing region compared to the spacing (Da), the depressurized degree in the inner diameter expansion part 300 is relatively less depressurized or is not depressurized compared to the depressurized degree in the other portion.

This is the same as the effect that the length (L1) of the first orifice 110 becomes relatively shorter than the length (L2) of the second orifice 210 as in the second embodiment.

That is, referring to FIG. 8B, under a condition that the lengths (L1, L2) of the first and second orifices 110, 210 are initially the same, as the inner diameter expansion part 300 is processed by a length (Lc) inside the first oil recovery passage 94, the length of the first spiral part 120 that actually generates the depressurized on the outer circumferential surface of the first orifice 110 is shortened to 'La' (which is the length same as the length (Lb) of the second spiral part before being shortened).

Since this becomes shorter than the length (Lb) of the second spiral part 220 that actually generates the depressurized on the outer circumferential surface of the second orifice 210, the depressurized resistance value of the first orifice 110 is reduced relatively compared to the second orifice 210.

The fifth embodiment of the present disclosure is configured so that the depressurized resistance value (Ra) of the first depressurized member 100 is smaller than the depressurized resistance value (Rb) of the second depressurized member 200 by the structure of the inner diameter expansion part 300 described above. That is, when the refrigerant passes through the first depressurized member 100 is depressurized relatively smaller than when passing through the second depressurized member 200.

That is, the designer may adjust the placement length (Lc) of the inner diameter expansion part 300 from the length (L1) of the first oil recovery passage to adjust the depressurized range of the refrigerant flowing through the first spiral part 120 of the first orifice 110.

Therefore, the pressure (Pc) of the back pressure chamber (B) is higher than the conventional pressure value, which may increase the back pressure, thereby pushing the orbiting scroll 42 toward the fixed scroll 41 more strongly upon driving under a high pressure condition.

Additionally, if the lengths (L1, L2) of the first and second orifices 110, 210 are configured to be the same as in the first embodiment, the passage spacing (S1) formed by the first spiral part 120 may be configured to be greater than the passage spacing (S2) formed by the second spiral part 220 in order to provide a difference in the depressurized resistance value. Since the detailed description is the same as in the above-described first embodiment, it will be omitted. In this case, it is possible to design a difference in the various depressurized resistance value together with the inner diameter expansion part 300.

The foregoing merely illustrates specific embodiments of the scroll compressor.

Therefore, it is revealed that it may be easily grasped by those skilled in the art that the substitutes and modifications of the present disclosure may be made in various forms without departing from the gist of the present disclosure recited in the appended claims.

What is claimed is:

1. A scroll compressor, comprising:

a casing;

a drive part disposed in a drive part accommodation space formed inside the casing and for rotating a drive shaft;

a center head in which the drive shaft passes through and is disposed and connected to the casing;

an orbiting scroll connected to the drive shaft;

a fixed scroll fixed to the inside of the casing, and forming a compression chamber for compressing refrigerant by the interaction with the orbiting scroll;

a discharge chamber formed on one side portion of the casing and through which the refrigerant is discharged;

a back pressure chamber formed between the center head and the orbiting scroll;

an oil recovery part for connecting an oil separator of the discharge chamber with a branch point branched to a back pressure chamber passage and a suction chamber passage formed in the center head, and for depressurizing the refrigerant and recovering oil;

a first depressurized member disposed on a first oil recovery passage formed between the oil separator of the discharge chamber and the branch point in the oil recovery part, and for depressurizing the refrigerant; and a second depressurized member disposed on a second oil recovery passage formed between the branch point and the suction chamber passage in the oil recovery part, and for depressurizing the refrigerant, wherein a depressurized resistance value of the first depressurized member is smaller than a depressurized resistance value of the second depressurized member;

wherein the first depressurized member comprises a first orifice, and a first spiral part wound a plurality of times is formed on an inner circumferential surface of the first orifice, wherein the second depressurized member comprises a second orifice, and a second spiral part wound a plurality of times is formed on an inner circumferential surface of the second orifice, and wherein a passage spacing (S1) formed by the first spiral part is greater than a passage spacing (S2) formed by the second spiral part.

2. A scroll compressor, comprising:

a casing;

a drive part disposed in a drive part accommodation space formed inside the casing and for rotating a drive shaft;

a center head in which the drive shaft passes through and is disposed and connected to the casing;

an orbiting scroll connected to the drive shaft;

a fixed scroll fixed to the inside of the casing, and forming a compression chamber for compressing refrigerant by the interaction with the orbiting scroll;

a discharge chamber formed on one side portion of the casing and through which the refrigerant is discharged;

a back pressure chamber formed between the center head and the orbiting scroll;

an oil recovery part for connecting an oil separator of the discharge chamber with a branch point branched to a back pressure chamber passage and a suction chamber passage formed in the center head, and for depressurizing the refrigerant and recovering oil;

a first depressurized member disposed on a first oil recovery passage formed between the oil separator of the discharge chamber and the branch point in the oil recovery part, and for depressurizing the refrigerant; and a second depressurized member disposed on a second oil recovery passage formed between the branch point and the suction chamber passage in the oil recovery part, and for depressurizing the refrigerant, wherein a depressurized resistance value of the first depressurized member is smaller than a depressurized resistance value of the second depressurized member wherein the first depressurized member comprises a first orifice, and a first spiral part wound a plurality of times is formed on an inner circumferential surface of the first orifice, wherein the second depressurized member comprises a second orifice, and a second spiral part wound a plurality of times is formed on an inner circumferential surface of the second orifice, and wherein a length (L1) of the first orifice is shorter than a length (L2) of the second orifice.

3. A scroll compressor, comprising:

a casing;

a drive part disposed in a drive part accommodation space formed inside the casing and for rotating a drive shaft;

a center head in which the drive shaft passes through and is disposed and connected to the casing;

an orbiting scroll connected to the drive shaft;

a fixed scroll fixed to the inside of the casing, and forming a compression chamber for compressing refrigerant by the interaction with the orbiting scroll;

a discharge chamber formed on one side portion of the casing and through which the refrigerant is discharged;

a back pressure chamber formed between the center head and the orbiting scroll;

an oil recovery part for connecting an oil separator of the discharge chamber with a branch point branched to a back pressure chamber passage and a suction chamber passage formed in the center head, and for depressurizing the refrigerant and recovering oil;

a first depressurized member disposed on a first oil recovery passage formed between the oil separator of the discharge chamber and the branch point in the oil recovery part, and for depressurizing the refrigerant; and a second depressurized member disposed on a second oil recovery passage formed between the branch point and the suction chamber passage in the oil recovery part, and for depressurizing the refrigerant, wherein a depressurized resistance value of the first depressurized member is smaller than a depressurized resistance value of the second depressurized member, wherein the first depressurized member comprises a depressurized check valve, wherein the second depressurized member comprises a second orifice, and a second spiral part wound a plurality of times is formed on an inner circumferential surface of the second orifice, and wherein a depressurized resistance value of the depressurized check valve is smaller than a depressurized resistance value of the second orifice.

4. A scroll compressor, comprising:

a casing;

a drive part disposed in a drive part accommodation space formed inside the casing and for rotating a drive shaft;

a center head in which the drive shaft passes through and is disposed and connected to the casing;

an orbiting scroll connected to the drive shaft;

a fixed scroll fixed to the inside of the casing, and forming a compression chamber for compressing refrigerant by the interaction with the orbiting scroll;

a discharge chamber formed on one side portion of the casing and through which the refrigerant is discharged;

a back pressure chamber formed between the center head and the orbiting scroll;

an oil recovery part for connecting an oil separator of the discharge chamber with a branch point branched to a back pressure chamber passage and a suction chamber passage formed in the center head, and for depressurizing the refrigerant and recovering oil;

a first depressurized member disposed on a first oil recovery passage formed between the oil separator of the discharge chamber and the branch point in the oil recovery part, and for depressurizing the refrigerant; and a second depressurized member disposed on a second oil recovery passage formed between the branch point and the suction chamber passage in the oil recovery part, and for depressurizing the refrigerant, wherein a depressurized resistance value of the first depressurized member is smaller than a depressurized resistance value of the second depressurized member, wherein the first depressurized member comprises a depressurized check valve connected with the oil separator of the discharge chamber; and a first orifice disposed between the depressurized check valve and the branch point, and having a first spiral part wound a plurality of times formed on the outer circumferential surface thereof, wherein the second depressurized member comprises a second orifice having a second spiral part wound a plurality of times formed on the outer circumferential surface thereof, and wherein a total depressurized resistance value formed by the depressurized check valve and the first orifice is smaller than a depressurized resistance value of the second orifice.

5. The scroll compressor of claim 4, wherein a passage spacing (S1) formed by the first spiral part is greater than a passage spacing (S2) formed by the second spiral part.

6. The scroll compressor of claim 5, wherein a length (L1) of the first orifice is shorter than a length (L2) of the second orifice.

7. The scroll compressor of claim 4, wherein a length (L1) of the first orifice is shorter than a length (L2) of the second orifice.

8. A scroll compressor, comprising:

a casing;

a drive part disposed in a drive part accommodation space formed inside the casing and for rotating a drive shaft;

a center head in which the drive shaft passes through and is disposed and connected to the casing;

an orbiting scroll connected to the drive shaft;

a fixed scroll fixed to the inside of the casing, and forming a compression chamber for compressing refrigerant by the interaction with the orbiting scroll;

a discharge chamber formed on one side portion of the casing and through which the refrigerant is discharged;

a back pressure chamber formed between the center head and the orbiting scroll;

oil recovery part for connecting an oil separator of the discharge chamber with a branch point branched to a back pressure chamber passage and a suction chamber passage formed in the center head, and for depressurizing the refrigerant and recovering oil;

a first depressurized member disposed on a first oil recovery passage formed between the oil separator of the discharge chamber and the branch point in the oil recovery part, and for depressurizing the refrigerant; and a second depressurized member disposed on a second oil recovery passage formed between the branch point and the suction chamber passage in the oil recovery part, and for depressurizing the refrigerant, wherein a depressurized resistance value of the first depressurized member is smaller than a depressurized resistance value of the second depressurized member, wherein the first depressurized member comprises a first orifice, and a first spiral part wound a plurality of times is formed on an inner circumferential surface of the first orifice, wherein the second depressurized member comprises a second orifice, and a second spiral part wound a plurality of times is formed on an inner circumferential surface of the second orifice, and wherein at least a portion of the inner surface of the first oil recovery passage is formed with an inner diameter expansion part having a greater spacing with the first orifice.

9. The scroll compressor of claim 8, wherein the inner diameter expansion part is formed at the side adjacent to the branch point on the first oil recovery passage.

10. The scroll compressor of claim 9, wherein an inner diameter (Db) of the inner diameter expansion part is configured to be greater than an inner diameter (Da) of the first oil recovery passage, and the refrigerant flowing through the first spiral part of the first orifice on the inner diameter expansion part is relatively less depressurized or is not depressurized.

11. The scroll compressor of claim 9, wherein a placement length (Lc) of the inner diameter expansion part is adjusted from a length (L1) of the first oil recovery passage to adjust a depressurized range of the refrigerant flowing through the first spiral part of the first orifice.

12. The scroll compressor of claim 9, wherein an outer diameter of the first orifice comprising the first spiral part is configured to be equal to or great than an inner diameter (Da) of the first oil recovery passage so that the first orifice is press-fitted into and position-fixed to the first oil recovery passage, and wherein an outer diameter of the second orifice comprising the second spiral part is configured to be equal to or great than an inner diameter (Da) of the second oil recovery passage so that the second orifice is press-fitted into and position-fixed to the second oil recovery passage.

13. The scroll compressor of claim 9, wherein a passage spacing (S1) formed by the first spiral part is greater than a passage spacing (S2) formed by the second spiral part.

14. The scroll compressor of claim 8, wherein an inner diameter (Db) of the inner diameter expansion part is configured to be greater than an inner diameter (Da) of the first oil recovery passage, and the refrigerant flowing through the first spiral part of the first orifice on the inner diameter expansion part is relatively less depressurized or is not depressurized.

15. The scroll compressor of claim 8, wherein a placement length (Lc) of the inner diameter expansion part is adjusted from a length (L1) of the first oil recovery passage to adjust a depressurized range of the refrigerant flowing through the first spiral part of the first orifice.

16. The scroll compressor of claim 8, wherein an outer diameter of the first orifice comprising the first spiral part is configured to be equal to or great than an inner diameter (Da) of the first oil recovery passage so that the first orifice is press-fitted into and position-fixed to the first oil recovery passage, and wherein an outer diameter of the second orifice comprising the second spiral part is configured to be equal to or great than an inner diameter (Da) of the second oil recovery passage so that the second orifice is press-fitted into and position-fixed to the second oil recovery passage.

17. The scroll compressor of claim 8, wherein a passage spacing (S1) formed by the first spiral part is greater than a passage spacing (S2) formed by the second spiral part.

18. The scroll compressor of claim 8, wherein the first oil recovery passage is formed through a wall portion of the fixed scroll, and wherein a sealing member is disposed between the first depressurized member and the second depressurized member.

19. The scroll compressor of claim 8, wherein the first depressurized member is inserted from the oil separator toward the branch point on the first oil recovery passage, and the second depressurized member is inserted from the branch point toward the suction chamber on the second oil recovery passage, and wherein oil passes through the first and second depressurized members in the oil separator and is recovered toward the suction chamber.

* * * * *